US009310773B2

(12) United States Patent
Hirokawa et al.

(10) Patent No.: US 9,310,773 B2
(45) Date of Patent: Apr. 12, 2016

(54) ANALOG ELECTRONIC TIMEPIECE

(71) Applicant: CASIO COMPUTER CO., LTD., Shibuya-ku, Tokyo (JP)

(72) Inventors: Jyunichi Hirokawa, Akishima (JP); Shigeki Hisada, Mitaka (JP); Teruhisa Tokiwa, Kunitachi (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 0 days.

(21) Appl. No.: 13/962,882

(22) Filed: Aug. 8, 2013

(65) Prior Publication Data

US 2014/0064040 A1 Mar. 6, 2014

(30) Foreign Application Priority Data

Aug. 31, 2012 (JP) ..... 2012-190908

(51) Int. Cl.

| | |
|---|---|
| ***G04C 15/00*** | (2006.01) |
| ***G04B 19/04*** | (2006.01) |
| ***G04B 19/06*** | (2006.01) |
| ***G04B 19/02*** | (2006.01) |
| ***G04B 19/00*** | (2006.01) |
| ***G04B 25/00*** | (2006.01) |
| ***G04C 17/00*** | (2006.01) |
| ***G04B 13/02*** | (2006.01) |
| ***G04B 13/00*** | (2006.01) |
| ***G04G 5/00*** | (2013.01) |
| ***G04B 35/00*** | (2006.01) |
| ***G04C 3/14*** | (2006.01) |

(52) U.S. Cl.

CPC ..... *G04B 19/02* (2013.01); *G04B 13/00* (2013.01); *G04B 13/027* (2013.01); *G04B 35/00* (2013.01); *G04C 3/146* (2013.01); *G04G 5/00* (2013.01)

(58) Field of Classification Search

CPC ..... G04B 13/00; G04B 13/027; G04B 35/00; G04C 3/14; G04C 3/143; G04C 3/146

USPC ..... 368/62, 80, 81, 220–221, 223–225, 368/228, 238

See application file for complete search history.

(56) References Cited

U.S. PATENT DOCUMENTS 5,245,591 A * 9/1993 Katou ..... 368/80
5,280,459 A * 1/1994 Nakamura ..... 368/80

(Continued)

FOREIGN PATENT DOCUMENTS

JP 2008-209259 A 9/2008
JP 2011-191220 A 9/2011

*Primary Examiner* — Amy Cohen Johnson
*Assistant Examiner* — Daniel Wicklund
(74) *Attorney, Agent, or Firm* — Holtz, Holtz & Volek PC

(57) ABSTRACT

An analog electronic timepiece includes a stepping motor, a gear train mechanism having gears, a pointer, a drive control unit, a control content changing unit, and a pointer position adjustment unit. If an operational command to rotate the pointer to a different moving target position is obtained while an operational control for rotating the pointer to a certain moving target position is in progress, the control content changing unit terminates the control and changes a control content to an operational control according to the command. If the reverse rotation driving operation is being performed, the pointer position adjustment unit performs an adjustment operation for removing shifting between a predicted position of the pointer and an actual position of the pointer which occurs because of rotational input from the stepping motor not being transmitted to the pointer due to gaps relating to the mesh of the gears.

4 Claims, 4 Drawing Sheets

(56) References Cited

U.S. PATENT DOCUMENTS 5,802,016 A * 9/1998 Kubota et al. ..... 368/11
6,278,661 B1 * 8/2001 Higuchi et al. ..... 368/28
6,894,952 B2 * 5/2005 Morokawa et al. ..... 368/80
2009/0161120 A1 * 6/2009 Kojima ..... 356/615
2011/0063953 A1 * 3/2011 Hasegawa et al. ..... 368/80
2014/0092714 A1 * 4/2014 Nagareda et al. ..... 368/187

* cited by examiner

FIG. 3A

| | | | | | | | |
|---|---|---|---|---|---|---|---|
| TARGET POSITION | 0 | DURING NORMAL ROTATION (+20) | 20 | NORMAL ROTATION (+20) | 40 | REVERSE ROTATION FLAG | × |
| INDICATED POSITION | 0 | | 20 | | 40 | REMOVAL PROCESS | × |
| BACKLASH | 0 | | 0 | | 0 | | |

FIG. 3B

| | | | | | | | |
|---|---|---|---|---|---|---|---|
| TARGET POSITION | 0 | DURING NORMAL ROTATION (+20) | 20 | REVERSE ROTATION (-20) | 0 | REVERSE ROTATION FLAG | × |
| INDICATED POSITION | 0 | | 20 | | 10 | REMOVAL PROCESS | ○ |
| BACKLASH | 0 | | 0 | | 10 | | |

FIG. 3C

| | | | | | | | |
|---|---|---|---|---|---|---|---|
| TARGET POSITION | 0 | DURING REVERSE ROTATION (-20) | -20 | NORMAL ROTATION (+5) | -15 | REVERSE ROTATION FLAG | ○ |
| INDICATED POSITION | 0 | | -10 | | -10 | REMOVAL PROCESS | ○ |
| BACKLASH | 0 | | 0 | | 5 | | |

FIG. 3D

| | | | | | | | |
|---|---|---|---|---|---|---|---|
| TARGET POSITION | 0 | DURING REVERSE ROTATION (-20) | -20 | NORMAL ROTATION (+20) | 0 | REVERSE ROTATION FLAG | ○ |
| INDICATED POSITION | 0 | | -10 | | 0 | REMOVAL PROCESS | × |
| BACKLASH | 0 | | 10 | | 0 | | |

FIG. 3E

| | | | | | | | |
|---|---|---|---|---|---|---|---|
| TARGET POSITION | 0 | DURING REVERSE ROTATION (-20) | -20 | REVERSE ROTATION (-20) | -40 | REVERSE ROTATION FLAG | ○ |
| INDICATED POSITION | 0 | | -10 | | -30 | REMOVAL PROCESS | ○ |
| BACKLASH | 0 | | 10 | | 10 | | |

| | | | | | |
|---|---|---|---|---|---|
| TARGET POSITION | 0 | REVERSE ROTATION (-20) | -20 | BACKLASH REMOVAL (REVERSE ROTATION) | -30 | BACKLASH REMOVAL (NORMAL ROTATION) | -20 |
| INDICATED POSITION | 0 | | -10 | | -20 | | -20 |
| BACKLASH | 0 | | 10 | | 10 | | 0 |

FIG. 4A

| | | | | | |
|---|---|---|---|---|---|
| TARGET POSITION | 0 | REVERSE ROTATION (-20) | -20 | DURING BACKLASH REMOVAL (REVERSE ROTATION) | -25 | NORMAL ROTATION (+2) | -23 |
| INDICATED POSITION | 0 | | -10 | | -15 | | -15 |
| BACKLASH | 0 | | 10 | | 10 | | 8 |

FIG. 4B

| | | | | | |
|---|---|---|---|---|---|
| TARGET POSITION | 0 | REVERSE ROTATION (-20) | -20 | BACKLASH REMOVAL (REVERSE ROTATION) | -30 | DURING BACKLASH REMOVAL (NORMAL ROTATION) | -25 | NORMAL ROTATION (+2) | -23 |
| INDICATED POSITION | 0 | | -10 | | -20 | | -20 | | -20 |
| BACKLASH | 0 | | 10 | | 10 | | 5 | | 3 |

FIG. 4C

ANALOG ELECTRONIC TIMEPIECE

BACKGROUND OF THE INVENTION

1. Field of the Invention

The present invention relates to an analog electronic timepiece which displays the time with pointers.

2. Description of Related Art

Conventionally, analog electronic timepieces which display the time by the rotatable pointers pointing at predetermined directions (positions) are known. In such analog electronic timepieces, rotational operation of motors is transmitted to the gear train mechanisms wherein a plurality of gears are arranged and the pointers which rotate in conjunction with the last gears in the gear trains mechanisms move in the normal rotation direction and the reverse rotation direction.

In the meshing of the gears which constitute a gear train mechanism, gaps (play spaces) which are called backlash are provided assuming that the gears can be modified slightly due to various causes such as temperature variation and aging. Therefore, there are cases where rotation cannot be transmitted to the last gear in the gear train mechanism and to the pointer connected to the last gear when the first gear in the gear train mechanism is rotated in a state having gaps in the meshing.

Influence of such backlash is notable when the rotation direction of the pointer is reversed. If the gears in a gear train mechanism are arranged so that they are meshed with no gaps with respect to the rotation of a pointer in one direction, the gaps are at their maximum size with respect to the rotation of the pointer in the opposite direction. Therefore, the pointer does not move with the rotation operation of the motor for the number of steps corresponding to the maximum size of gaps. As a result, the position of the pointer predicted from the number of times the motor is driven and the position of the actual display of the pointer may not match and there may be a time lag until the reverse rotation of the pointer is started. In view of the above, techniques for removing the influence of backlash without fail and operating the motor in advance for the number of steps corresponding to the gaps so that there will be no gap between the gears in the direction of the next rotation are disclose in JP 2008-209259 and JP 2011-191220, for example.

However, in analog electronic timepieces, because it takes time to move a pointer to the moving target position, there are cases where different fast forwarding movement is started while the pointer is moving fast forward. In such cases, the influence of backlash cannot be removed appropriately and the position where the pointer points may be different from the predicted position in the conventional configuration.

The present invention is an analog electronic timepiece which can easily adjust the position of a pointer to a desired display position without fail when fast forwarding operation is completed.

SUMMARY OF THE INVENTION

According to one aspect of the present invention, there is provided an analog electronic timepiece including a stepping motor, a gear train mechanism for transmitting rotation which is input from the stepping motor by a plurality of gears meshing, a drive control unit which performs operational control of a pointer which rotates by a predetermined angle unit and the stepping motor according to the rotation transmitted by the gear train mechanism, a control content changing unit which, if an operational command to rotate the pointer to a different moving target position is obtained while an operational control for rotating the pointer to a certain moving target position is in progress, terminates the operational control and changes a control content to an operational control according to the operational command, a rotation direction determination unit which, when the operational control wherein the control content is changed by the control content changing unit is completed, determines whether the stepping motor is made to perform a reverse rotation driving operation to rotate the pointer in a direction opposite to a predetermined reference rotation direction in a series of operational control including an operational control performed before the changing of the control content and an operational control performed after the changing of the control content and a pointer position adjustment unit which, if the reverse rotation driving operation is determined as being performed, performs a predetermined position adjustment operation for removing a shifting between a position of the pointer predicted from a number of rotational input from the stepping motor and an actual position of the pointer which occurs because of rotational input from the stepping motor not being transmitted to the pointer due to the gaps relating to the mesh of the plurality of gears in the gear train mechanism.

BRIEF DESCRIPTION OF THE DRAWINGS

The above an other objects, advantages and features of the present invention will become more fully understood from the detailed description given hereinbelow and the appended drawings which are given by way of illustration only, and thus are not intended as a definition of the limits of the present invention, and wherein:

FIGS. 3A to 3E are tables referred to for explaining operation examples of the fast forwarding process of a pointer; and FIGS. 4A to 4C are tables referred to for explaining operation examples of the fast forwarding process of a pointer.

DESCRIPTION OF THE PREFERRED EMBODIMENTS

Hereinafter, an embodiment of the present invention will be described with reference to the drawings.

Figure 1:
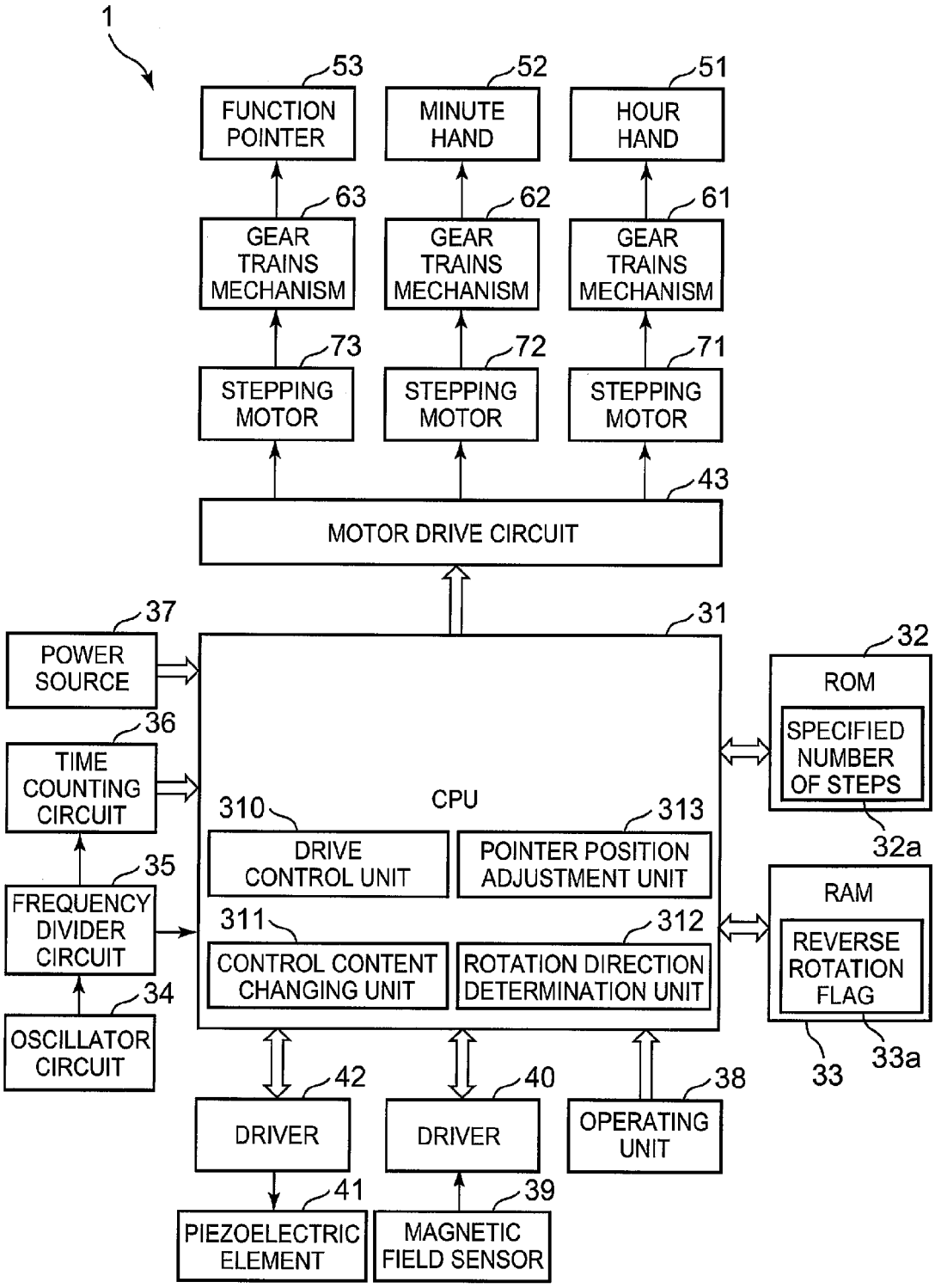
FIG. 1 is a block diagram showing an inner configuration of an analog electronic timepiece according to the embodiment of the present invention.

FIG. 1 is a block diagram showing an inner configuration of the analog electronic timepiece 1 according to the embodiment.

The analog electronic timepiece 1 can perform displaying according to various types of functions such as a world clock function, an alarm function, a timer function and a compass function, for example, in addition to a present time display function. The analog electronic timepiece 1 includes a CPU 31 (Central Processing Unit) (a drive control unit 310, a control content changing unit 311, a rotation direction determination unit 312, a pointer position adjustment unit 313), a ROM 32 (Read Only Memory), a RAM 33 (Random Access Memory), an oscillator circuit 34, a frequency divider circuit 35, a time counting circuit 36, a power source 37, an operating unit 38, a magnetic field sensor 39, a driver 40 for the magnetic filed sensor, a piezoelectric element 41, a driver 42 for the piezoelectric element, a motor drive circuit 43, a hour hand 51, a minute hand 52, a function pointer 53, gear train mechanisms 61 to 63 each of which being configured of a plurality of gears, stepping motors 71 to 73 and such like.

The stepping motor 71 rotates the hour hand 51 by a unit of predetermined angle (for example, 1 degree) via the gear train mechanism 61. The stepping motor 72 rotates the minute hand 52 by a unit of predetermined angle via the gear train mechanism 62. The stepping motor 73 rotates the function pointer 53 by a unit of predetermined angle via the gear train mechanism 63. That is, in the analog electronic timepiece 1 of the embodiment, the hour hand 51, the minute hand 52 and the function pointer 53 are rotated independently by the stepping motors 71 to 73, respectively. The stepping motors 71 to 73 respectively drive the pointers so as to rotate in both normal rotation direction (reference rotation direction, clockwise rotation direction) and reverse rotation direction (opposite direction). The mechanisms of the rotation of the hour hand 51, the minute hand 52 and the function pointer 53 are similar to each other and hereinafter, in a case where any one of them is being specifically described, the hour hand 51, the minute hand 52 or the function pointer 53 is referred to simply as the pointer. The hour hand 51 and the minute hand 52 respectively displays the hour and minute and also displays values and information relating to various functions when performing time display. The function pointer 53 indicates the type of function which the analog electric timepiece 1 is currently performing.

In the gear train mechanisms 61 to 63, individual backlash exist. If the rotors of the stepping motors 71 to 73 are rotationally driven, only a part of the gears in the gear train mechanisms 61 to 63 rotate in the condition where there are gaps relating to the backlash in the rotation direction, and the rotation of the rotors are not transmitted to the pointers 51 to 53.

On the basis of the control signals input from the CPU 31, the motor drive circuit 43 outputs driving voltage waveforms for rotationally driving the stepping motors 71 to 73.

The CPU 31 collectively controls the entire operation of the analog electric timepiece 1 and performs various types of arithmetic operations. The CPU 31 makes the analog electric timepiece 1 of the embodiment perform switching between and displaying of various types of functions.

In the ROM 32, various types of control programs which are executed by the CPU 31 and the initial setting data used in the control programs are stored. The initial setting data in the ROM 32 includes the specified number of steps 32*a* (the maximum number of steps relating to shifting) which is a data table of the numbers of operation steps (how many times the stepping motors 71 to 73 are driven) corresponding to the sizes of the backlash in the gear train mechanisms 61 to 63 of the analog electronic timepiece 1. As the specified number of steps 32*a*, the maximum values that can be predicted during when the analog electronic timepiece 1 is being used are set considering temperature variations and aging.

The RAM 33 provides a working memory space for the CPU 31 and temporarily stores data. In the RAM 33, reverse rotation flags 33*a* (reverse rotation drive execution flag) which are set with respect to the pointers 51 to 53 are stored. Each reverse rotation flag 33*a* is binary data indicating whether fast forwarding of the pointer is performed (set/reset) within a predetermined period. Alternatively, each reverse rotation flag 33*a* may be multivalued data, and for example, the number of steps needed for dissolving the gaps in the normal rotation direction relating to the backlash in each of the gear train mechanisms 61 to 63 may be stored.

The oscillator circuit 34 is a crystal-oscillator circuit, for example, and generates and outputs signals of predetermined frequency. The frequency divider circuit 35 divides the signals of predetermined frequency output from the oscillator circuit 34 in various frequencies used in the CPU 31 and the time counting circuit 36 and outputs the divided signals. The time counting circuit 36 counts the frequency signal pulses input from the frequency divider circuit 35 and counts the current time by adding the counted number of frequency signal pulses to the initial time.

The power source 37 supplies the necessary power in predetermined voltages to the CPU 31 and the components of the analog electronic timepiece 1. The power source 37 can supply power continuously for a long period of time and, for example, a combination of a solar battery and a secondary battery is used as the power source 37.

The operating unit 38 receives input operations performed by a user, converts the input operations into electric signals and outputs the electric signals to the CPU 31. The operating unit 38 includes push button switches and a knob, and the functions of the analog electronic timepiece 1 are switched among them by a user pushing the push button switches and rotating the knob. Thereby, changing of operation condition and moving of pointer positions according to input of settings are carried out. The push button switches may include a short-cut switch for immediately switching between the compass function and the other functions.

The magnetic field sensor 39 is a sensor for detecting the earth magnetic field (magnetic pole) direction by measuring the magnetic field intensity of two axes directions or of three axes directions, the axes being orthogonal to each other. Here, as the magnetic filed sensor 39, a small and light semiconductor sensor is used. The magnetic filed sensor 39 operates under the control of the driver 40 and outputs the magnetic filed data to the CPU 31, digital conversion being performed on the magnetic filed data at a predetermined sampling frequency.

The piezoelectric element 41 generates a buzzer tone according to the voltage signal which is supplied from the driver 42. As for the piezoelectric element 41, PZT is used, for example. The buzzer tone is used for notifying the alarm time and notifying that the time set by a timer has elapsed.

Next, a pointer fast forwarding operation in the analog electronic timepiece 1 of the embodiment will be described.

In the analog electronic timepiece 1 of the embodiment, a correction operation (position adjustment operation) relating to backlash is performed as needed after the pointer fast forwarding operation is performed. In other words, in the analog electronic timepiece 1, in a case where forming of a gap and shifting of position caused by backlash with respect to the rotation in the normal rotational direction due to the pointer fast forwarding operation occur, the gear train mechanisms are rotated to dissolve the shifting of their positions due to the backlash so as to put the gears of the gear train mechanism in a fit condition with respect to the rotation in the normal rotational direction.

Figure 2:
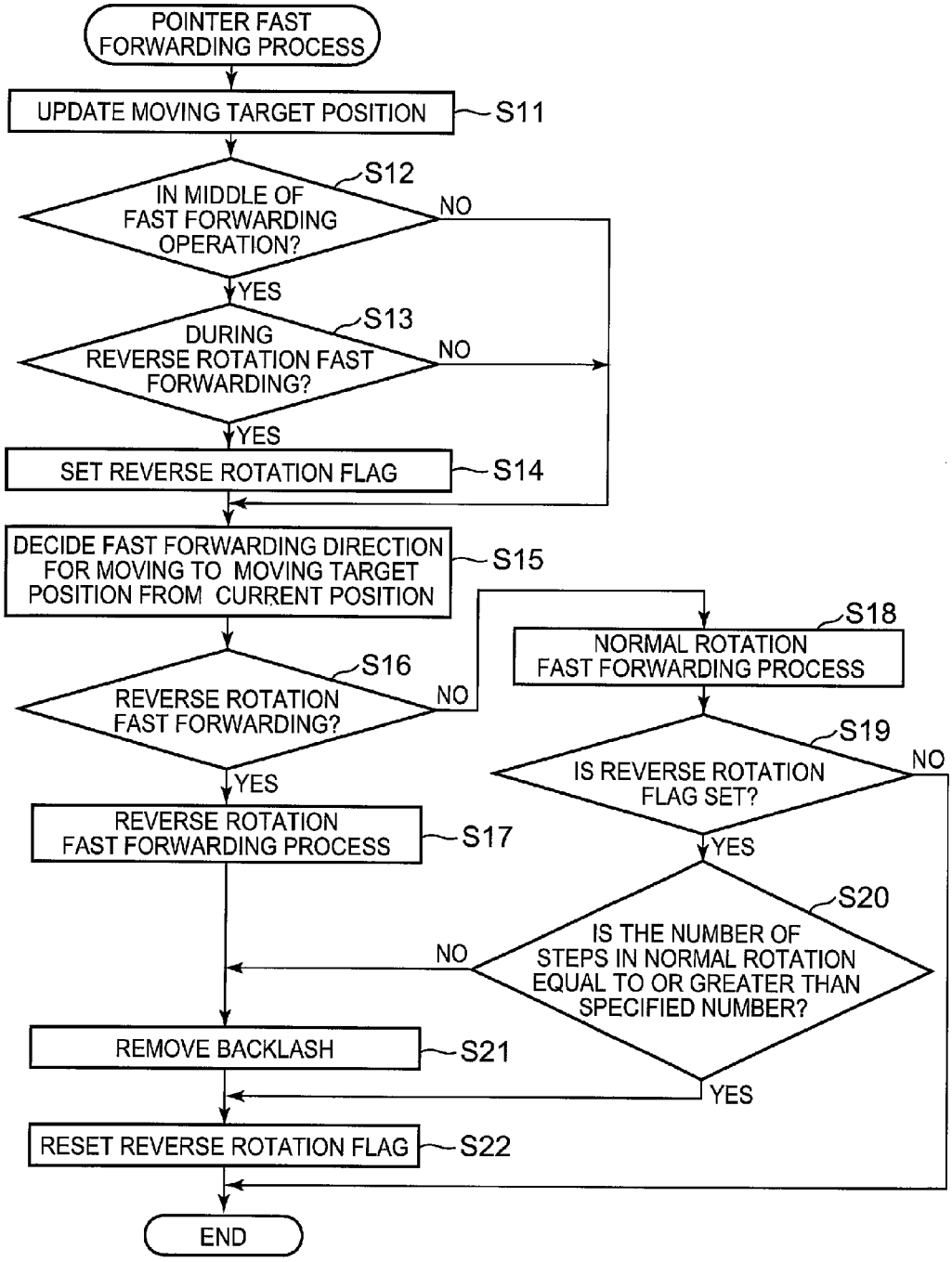
FIG. 2 is a flowchart showing a control procedure of a fast forwarding process of a pointer.

FIG. 2 is a flowchart showing a control procedure performed by the CPU 31 in the pointer fast forwarding process that is executed in the analog electronic timepiece 1 of the embodiment.

The pointer fast forwarding process is driven and executed as needed when a direct operation command to move the position of a pointer or an indirect command to move a pointer according to a switching request of functional operations are input from the operating unit 38 and when there is a need to move a pointer by fast forwarding to control the timepiece. This process is carried out individually for each of the pointers 51 to 53. If a command for a new process with respect to the same pointer is obtained in the middle of execution of the previous pointer fast forwarding process, the previous pointer fast forwarding process is forcefully terminated and the new process is activated.

When the pointer fast forwarding process starts, the CPU 31 first updates the setting of a moving target position (one moving target position, other moving target positions) which is set according to the content of the pointer fast forward command (step S11). Next, the CPU 31 determines whether the previous pointer fast forwarding process is in progress (step S12). If it is determined that the previous pointer fast forwarding process is not in progress, the CPU 31 proceeds to step S15. If it is determined that the previous pointer fast forwarding process is in progress (step S12, YES), the CPU 31 next determines whether the pointer was being fast forward in reverse direction (opposite rotation driving operation) in the previous pointer fast forwarding process (step S13). If it is determined that the pointer was not being fast forward in reverse direction (step S13, NO), the CPU 31 proceeds to step S15.

If it is determined that the pointer was being fast forward in reverse direction (step S13, YES), the CPU 13 sets the reverse rotation flag 33*a* (step S14). Then, the CPU 31 proceeds to step S15.

After proceeding to step S15, the CPU 13 decides the fast forwarding direction for when fast forwarding the pointer which is target for fast forwarding to the set moving target position from the present position of the pointer. For example, the CPU 31 determines whether the pointer should be rotated in which direction in order to reach the moving target position in shorter time on the basis of the numbers of moving steps to the moving target position when rotating in the normal rotation direction and in reverse rotation direction and the fast forwarding speeds of rotations in the normal rotation direction and the reverse rotation direction. Then, the CPU 31 decides the fast forwarding direction.

Next, the CPU 31 determines whether the decided fast forwarding direction is the reverse rotation direction (step S16). If it is determined that the fast forwarding direction is the reverse rotation direction (step S16, YES), the CPU 31 outputs the control signal for fast forwarding the pointer in the reverse direction for the set number of steps to the motor drive circuit 43 (step S17). Then, the CPU 31 proceeds to step s21.

On the other hand, if it is determined that the fast forwarding direction is not the reverse direction (the fast forwarding direction is the normal rotation direction) (step S16, NO), the CPU 31 output the control signal for fast forwarding the pointer in the normal rotation direction for the set number of steps to the motor drive circuit 43 (step S18). When the fast forwarding of the pointer in the normal rotation direction is completed, the CPU 31 determines whether the reverse rotation flag 33*a* is set (step S19). If the reverse rotation flag 33*a* is not set (step S19, NO), the CPU 31 ends the processing.

If it is determined that the reverse rotation flag 33*a* is set (step S19, YES), the CPU 31 next refers to the specified number of steps 32*a* and determines whether the umber of steps in the normal rotation direction in the current fast forwarding in the normal rotation direction is equal to or more than the specified number of steps (specified number) for the backlash relating to the pointer which is target for the fast forwarding (step S20). If it is determined that the number of steps in the normal rotation direction in the current fast forwarding is equal to or more than the specified number of steps (step S20, YES), the CPU 31 proceeds to step S22. If it is determined that the number of steps in the normal rotation direction in the current fast forwarding is not equal to or more than the specified number of steps (step S20, NO), the CPU 31 proceeds to step S21.

After the process of step S17 or if it is determined that the number of steps in the normal rotation direction is not equal to or more than the specified number of steps in the determination process of step S20 (step S20, NO), the CPU 31 outputs the control signal for performing a predetermined operation of backlash removal to the motor drive circuit 43 (step S21). In particular, the CPU 31 moves the pointer by fast forwarding in the normal rotation direction for the specified number of steps and thereafter, performs the fast forwarding process for moving the pointer in the normal rotation direction for the same number of steps. Then, the CPU 31 proceeds to step S22.

After the process of step S21 or if it is determined that the number of steps in the normal rotation direction is equal to or more than the specified number of steps in the determination process of step S20 (step S20, YES), the CPU 31 resets the reverse flag 33*a* (step S22). Then, the CPU 31 ends the pointer fast forwarding process.

FIGS. 3A to 3E are tables for explaining specific examples of the pointer fast forwarding process.

In the examples, the initial position of the pointer is at the position of step "0". In the examples, the position where the pointer should be pointing (moving target position), the position where the pointer is actually pointing (pointing position and the change in backlash in a case where the fast forwarding movement according to the operation control relating to the first fast forwarding process of the pointer is carried out partway and the second fast forwarding process of the pointer is activated and the operation control thereof is carried out as a series of operation control of the fast forwarding movement are shown. The values of backlash in the tables correspond with the reverser flags 33*a* of multivalued data. That is, the values of backlash in the tables are values (margin) indicating the delayed number of steps when the pointers start moving in the normal rotation direction. For example, when this value is "2", this indicates that the pointer starts to move at the $3^{rd}$ step in the driving of the stepping motor in the normal rotation direction and the pointer starts to move at the $9^{th}$ step in the driving of the stepping motor in the reverse rotation direction. In a case where the pointer fast forwarding process is completed in a normal state, the backlash value is "0". In the examples, the specified number of backlash is "10".

First, FIG. 3A shows an example where the fast forwarding movement in the normal rotation direction is further set at the point when the pointer is fast forward for 20 steps in the normal rotation direction in the first fast forwarding process of the pointer (while the process of step S18 is in progress). Because gap do not occur with respect to the rotation in the normal rotation direction in the first fast forwarding process, the backlash value is "0" at the start of the second fast forwarding process of the pointer and the pointer is at the position of step "20". After the moving destination is updated to the position of step "40" (step S11), the process proceeds to "YES" in the determination process of step S12 and proceeds to "NO" in the determination process of step S13. Then, it is decided that the pointer is to be fast forward in the normal rotation direction for 20 steps (step S15) and this fast forwarding operation is executed (steps S16, S18). In such case, the pointer precisely moves to the position of step "40". Because the reverse rotation flag 33*a* is not set (reverse rotation flag: X) (step S19, NO), the backlash removal process is not performed (removal process: X) and the pointer fast forwarding process ends.

On the other hand, FIG. 3B shows an example where the fast forwarding movement in the reverse rotation direction is set at the point when the pointer is fast forward in the normal rotation direction for 20 steps in the first fast forwarding process of the pointer (while the process of step S28 is in progress). Because gap do not occur with respect to the rotation in the normal rotation direction in the first fast forwarding process, the backlash value remains as "0" at the start of the second fast forwarding process and the pointer is at the position of step "20". After the moving destination of the pointer is updated to the position of step "0" (step S11), the process proceeds to "YES" in the determination process of step S12 and proceeds to "NO" in the determination process of step S13 (reverse rotation flag: X). Then, it is decided that the pointer is to be fast forward in the reverse rotation direction for 20 steps (step S15) and this fast forwarding operation is executed (steps S16, S17). In such case, gap of 10 steps exists with respect to the rotation in the reverse rotation direction at the start of the fast forwarding in the process of step S17. Therefore, the pointer starts to move in the reverse rotation direction after a part of the gears in the gear train mechanism rotate freely for 10 steps (after the backlash value increases to "10"), and the pointer moves for the remaining 10 steps. In such way, the pointer position (the position of step "10") shifted from the moving target position (the position of step "0"), and this shifting is dissolved by the backlash removal processing being performed (step S21, removal process: ○). Then, the reset state of the reverse rotation flag 33*a* is maintained (step S22), and the pointer fast forwarding process ends.

FIG. 3C shows an example where the fast forwarding movement to the normal rotation direction for the number of steps smaller than the specified number of steps is set at the point when the pointer is fast forward in the reverse direction for 20 steps in the first fast forwarding process of the pointer (while the process of step S17 is in progress). In the first fast forwarding process, the pointer's position is influenced by the backlash. That is, at the start of the second fast forwarding process of the pointer, the backlash value is "10" and the position where the pointer points is the position of step "−10". After the moving destination of the pointer is updated to the position of step "−15" (step S11), the process proceeds to "YES" in the determination processes of steps S12 and S13 and the reverse rotation flag 33*a* is set (○) (step S14). Then, it is determined that the pointer is to be fast forward in the normal rotation direction for 5 steps (step S15), and this fast forwarding operation is executed (steps S16, S18). In such case, because rotation that is smaller than the size of the gap with respect to the rotation in the normal rotation direction is performed in the gear train mechanism which rotates the pointer, the pointer does not move from the position of step "−10" and only the backlash value is reduces by 5 steps to be set to "5". Due to the set reverse rotation flag 33*a*, the process proceeds to "YES" in the determination process of step S19. Then, the number of steps to be moved in the normal rotation direction is determined as no being equal to or more than the specified number of steps (step S20, NO), the backlash removal process is carried out (step S21, removal process: ○), the gap with respect to the rotation in the normal rotation direction is removed and the pointer is moved to the accurate position. Finally, the reverse rotation flag 33*a* is reset (step S22) and the pointer fast forwarding process ends.

FIG. 3D shows an example where the fast forwarding movement of the pointer in the normal rotation direction for the number of steps equal to or more than the specified number of steps is set at the point when the pointer is fast forward in the reverse rotation direction for 20 steps in the first fast forwarding processing of the pointer (while the process of step S17 is in progress). In the first fast forwarding process, the pointer's position is influenced by the backlash. That is, at the start of the second fast forwarding process, the backlash value is "10" and the position where the pointer points is the position of step "−10". After the moving destination of the pointer is updated to the position of step "0" (step S11), the process proceeds to "YES" in the determination processes of steps S12 and S13, and the reverse rotation flag 33*a* is set (○) (step S14). Then, it is decided that the pointer is fast forward in the normal rotation direction for 20 steps (step S15) and this fast forwarding operation is executed (steps S16, S18). In such case, in the gear train mechanism which rotates the pointer, the gears rotate for 10 steps corresponding to the gap that occurred with respect to the rotation in the normal rotation direction to that the backlash value is dissolved and set to "0", first. Thereafter, the pointer, which started to rotate, moves for the remaining 10 steps. In such way, the pointer returns to the position of step "0". Due to the set reverse rotation flag 33*a*, the process proceeds to "YES" in the determination process of step S19. However, because the number of steps to be rotated in the normal rotation direction is determined as being equal to or more than the specified number of steps (step S20, YES), the backlash removal process is not carried out (removal process: X), the reverse rotation flag 33*a* is reset (step S22), and the pointer fast forwarding process ends.

FIG. 3E shows an example where the fast forwarding movement of the pointer in the reverse rotation direction is further set at the point when the pointer is fast forward in the reverse rotation direction for 20 steps in the first fast forwarding process of the pointer (while the process of step S17 is in progress). In the first fast forwarding process, the pointer's position is influenced by the backlash. That is, at the start of the second fast forwarding process of the pointer, the backlash value is "10" and the position where the pointer points is the position of step "−10". After the moving destination of the pointer is updated to the position of step "−40" (step S11), the process proceeds to "YES" in the determination processes of steps S12 and S13, and the reverse rotation flag 33*a* is set (○) (step S14). Then, it is decided that the pointer is to be fast forward for 20 steps in the reverse rotation direction (step S15) and this fast forwarding operation is executed (steps S16, S17). In such case, because the gap with respect to the rotation in the reverse rotation direction is already dissolved, the backlash value is maintained as "10" and the pointer is rotated in the reverse rotation direction for 20 steps so that the pointer moves to the position of step "−30". Thereafter, the backlash removal proves is carried out (step S21, removal process: ○) and the pointer accurately points the position of step "−40". Finally, the reverse rotation flag 33*a* is reset (step S22) and the pointer fast forwarding process ends.

FIGS. 4A to 4C are tables showing other examples for explaining the pointer fast forwarding process.

The fast forwarding in reverse direction in which the pointer's position shifts due to the influence of backlash not only includes the normal fast forwarding of the pointer to the moving target position, but also includes a partway fast forwarding of the backlash removal operation (step S21) carried out after the normal fast forwarding in the reverse direction is performed. As shown in FIG. 4A, if the fast forwarding in the reverse direction for the specified number of steps and the fast forwarding in the normal rotation direction for the specified number of steps are performed completely after the fast forwarding in the reverse direction, the influence of backlash is removed and the pointer points the accurate target position. In contrary, as shown in FIG. 4B, in a case where the fast forwarding in the normal rotation direction is set in the middle of the fast forwarding in the reverse direction of the backlash removal (here, at step 5 in 10 steps) after the fast forwarding in the reverse rotation direction, the influence of backlash remains not being completely removed if the number of steps of the fast forwarding is smaller than the backlash value. Further, as shown in FIG. 4C, even in a case where the fast forwarding in the normal rotation direction is further set in the middle of the fast forwarding in the normal rotation direction (here, at step 5 in 10 steps) when the fast forwarding in the reverse direction of the backlash removal is completed after the fast forwarding in the reverse direction, the influence of backlash remains not being completely removed if the number of steps in the fast forwarding is smaller than the backlash value. Therefore, also in such cases, the pointer's position and meshing of gears in the gear train mechanism are to be in a normal state by the process of backlash removal being executed at the last in the pointer fast forwarding process relating to the newly set moving target position.

As described above, the analog electronic timepiece 1 of the embodiment includes the hour hand 51, the minute hand 52 and the function pointer 53 which individually moves by a predetermined angle according to the rotation transmitted respectively from the stepping motors 71 to 73 via the gear train mechanisms 61 to 63. When the pointer fast forwarding process of any one of the pointers is in progress and if another moving target position is set in the middle of the pointer fast forwarding process, the operation control of the process which is in progress is terminated and the operation control of the pointer fast forwarding process to move the pointer to the newly set moving target position is started. Such changing of the moving target position may be carried out a plurality of times. When the operation control is completed by the pointer reaching the moving target position by the pointer fast forwarding process wherein the previous processing is terminated, whether the pointer was fast forwarded in the reverse rotation direction in the series of operation control including the operation control performed before the termination and the operation control performed in relation to the newly set moving target position. If it is determined that the fast forwarding in the reverse direction was performed, the backlash removal operation is carried out. Accordingly, if the fast forwarding of the pointer is terminated in the middle of the fast forwarding, whether the fast forwarding in the reverse direction was performed in both the previous fast forwarding process, which was terminated, and in other fast forwarding process is determined after the last pointer fast forwarding process is completed, and removing of the backlash is to be carried out as needed. Therefore, the pointer can be moved to the accurate position more surely.

Thus, even if the fast forwarding direction is reversed in the middle when setting an alarm time such as in a case of changing the pointer to a different setting time in the middle of moving the pointer to the position of a certain setting time and in a case of further switching to another function operation mode during the switching of the function operation mode, whether the backlash removal process is needed is accurately determined and the process can be carried out as needed.

Further, because determination of fast forwarding in the reverse rotation direction and the backlash removal process are carried out once only when the last pointer fast forwarding is completed. Therefore, there is no need to operate the pointers in relation to the backlash removal more than needed and there is no need to delay the start of fast forwarding of the pointer to the changed moving target position more than needed.

Further, even in a case where the fast forwarding of the pointer in the reverse direction is carried out in the series of operation control, if the influence of backlash is surely removed by the fast forwarding of the pointer in the normal rotation direction afterward, there is no need to operate the pointer in relation to the backlash removal. Therefore, troubles in the operation can be reduced and the attractiveness to a user can be improved.

By counting the gap due to the backlash in the series of operation control itself, only the minimum operation relating to the backlash removal is to be carried out. Therefore, unneeded operation can be further cut out.

Whether there is an influence of backlash due to the reverse rotation fast forwarding is indicated by the reverse rotation flag 33*a* as binary data and stored. Therefore, the determination process of whether the reverse rotation fast forwarding is performed can be done promptly with small work load, and whether the backlash removal operation needs to be carried out can be determined easily.

Further, by positioning the meshing of gears in the gear train mechanism in the clockwise direction in compliance with the operation direction of the pointers when displaying the time and the elapsed time, the operation after the fast forwarding of the pointer, including the backlash removal, can be set so as to be performed promptly in many cases.

The present invention is not limited to the above described embodiment, and various modifications can be made.

For example, although the description is given for an example where the moving target position is changed only once in the above embodiment, the present invention can be similarly applied to a case where the moving target position is changed for a plurality of times. In such case, in the process of step S20 in the pointer fast forwarding process of the above embodiment, the accumulative of the number of steps in the normal direction rotation that are continuously performed can be compared to the specified number of steps after the reverse direction fast forwarding is performed. As for the accumulative, the value is initialized to be set to "0" when the reverse rotation flag is set in the process of step S14 and when the reverse rotation flag is reset in the process of step S22 and the value is added by 1 every time the normal rotation fast forwarding is performed in the process of step S18. The accumulative and the reverse rotation flag which is set in the process of step S14 are maintained until the reverse rotation flag is reset, even when the pointer fast forwarding process is terminated forcefully.

Instead of skipping the processes of steps S12 to S14 in the above embodiment, the reverse rotation flag 33*a* can be set if the process proceeds to "YES" in the determination processing of step S16, and the reverse rotation flag may not be reset when the process is terminated forcefully halfway through. In such way, if the reverse fast forwarding is included even just once in the previous pointer fast forwarding processes which were terminated halfway through or in the last pointer fast forward process, the reverse rotation flag is set without fail. Further, if the pointer fast forwarding process is to be completed normally at the end, the backlash removal is carried out without fail and the reverse rotation flag is set. Alternatively, the reverse rotation flag 33*a* may be added by 1 every time the reverse rotation fast forward is performed for 1 step in the process of step S17 without exceeding the specified number of steps and the reverse rotation flag 33*a* may be subtracted by 1 every time the normal rotation fast forwarding is performed for 1 step in the process of step S18 without going below 0.

Moreover, in the embodiment, the backlash removal is carried out so that the gap (margin) does not exist with respect to the movement in the normal rotation direction. However, there is no need for the backlash removal with respect to the normal rotation direction to be set all the time. For example, if a timer of a count down timer is to be set, because it is assumed that the pointer is moved in the reverser rotation direction after the setting operation, the backlash removal may be carried out so that the gap is dissolved with respect to the moving in the reverse rotation direction.

In the above embodiment, the case where the hour hand 51, the minute hand 52 and the function pointer 53 rotate individually. However, the present invention can be applied for each stepping motor even in a case where a plurality of pointers rotate in conjunction with one another.

In the above embodiment, a description is given for the configuration where whether fast forwarding in the reverse rotation direction is performed and whether the backlash removal is executed are determined on the basis of set/reset of the reverse rotation flag 33*a*. However, the size (the number of steps) of the gap relating to the backlash may be counted for each pointer at the beginning. According to such processing, the determination process of step S19 and the determination process of step S20 in the pointer fast forwarding process can be performed at once, as one determination process. Further, according to such processing, whether the backlash removal is needed can be determined more accurately.

Alternatively, the process of step S19 and the process of step S20 can be separate as they are and whether the backlash removal process is needed can be determined by considering whether the above counted gap of backlash exists in the determination process of step S20.

Details such as the specific configuration, numerical values, control procedures and the like shown in the description of the embodiment can be modified arbitrarily within the scope of the invention.

The entire disclosure of Japanese Patent Application No. 2012-190908 filed on Aug. 31, 2012 including description, claims drawings, and abstract are incorporated herein by reference is its entirety.

What is claimed is:

1. An analog electronic timepiece, comprising:

a stepping motor;

a gear train mechanism for transmitting rotation which is input from the stepping motor by a plurality of gears meshing;

a pointer which rotates by a predetermined angle unit according to the rotation transmitted by the gear train mechanism;

a storage unit which stores a specified number of steps corresponding to a shifting between a position of the pointer predicted from a number of rotational inputs from the stepping motor and an actual position of the pointer which occurs because of rotational input from the stepping motor not being transmitted to the pointer due to a gap relating to the meshing of the plurality of gears in the gear train mechanism;

a drive control unit which performs operational control of the stepping motor;

a control content changing unit which, if an operational command to rotate the pointer to a different moving target position is obtained while an operational control for rotating the pointer to a certain moving target position is in progress, terminates the operational control and changes a control content to an operational control according to the operational command;

a pointer position adjustment unit which, in response to completion of a series of operational control ending with a reverse rotation driving operation to rotate the pointer in a reverse rotation direction reverse from a predetermined reference rotation direction, performs a first position adjustment operation by which the pointer is rotated for the specified number of steps in the reverse rotation direction and then rotated for the specified number of steps in the reference rotation direction in order to remove the shifting caused by the gap; and a rotation direction determination unit which, in response to completion of a series of operational control ending with a reference direction rotation driving operation to rotate the pointer in the reference rotation direction, determines whether the stepping motor has been made to perform the reverse rotation driving operation during the series of operational control ending with the reference rotation driving operation; and wherein in response to the rotation determination unit determining that the stepping motor has been made to perform the reverse rotation driving operation during the series of operational control ending with the reference direction rotation driving operation, the pointer position adjustment unit determines whether or not the pointer has been rotated in the reference rotation direction for equal to or more than the specified number of steps after the reverse rotation driving operation;

wherein the pointer position adjustment unit does not perform any position adjustment operation if it is determined that the pointer has been rotated in the reference rotation direction for equal to or more than the specified number of steps after the reverse rotation driving operation in the series of operational control ending with the reference direction rotation driving operation; and wherein the pointer position adjustment unit performs a second position adjustment operation in order to remove the shifting caused by the gap if it is determined that the pointer has been rotated in the reference rotation direction for less than the specified number of steps after the reverse rotation driving operation in the series of operational control ending with the reference direction rotation driving operation.

2. The analog electronic timepiece according to claim 1, wherein the rotation direction determination unit sets a reverse rotation drive execution flag if the reverse rotation driving operation is performed, and determines whether the reverse rotation drive operation exists on the basis of the reverse rotation drive execution flag, and wherein the pointer position adjustment unit resets the reverse rotation drive execution flag if the first or second position adjustment operation is performed.

3. The analog electronic timepiece according to claim 2, wherein the reference rotation direction is a clockwise rotation direction.

4. The analog electronic timepiece according to claim 1, wherein the reference rotation direction is a clockwise rotation direction.

* * * * *